US008114035B2

(12) United States Patent
Quintana et al.

(10) Patent No.: US 8,114,035 B2
(45) **Date of Patent: *Feb. 14, 2012**

(54) METHODS AND DEVICES FOR ATTACHING A BELT CARTRIDGE TO A CHEST COMPRESSION DEVICE

(75) Inventors: Renaldo J. Quintana, Redwood City, CA (US); Paul Q. Escudero, Redwood City, CA (US); Charles E. Swinehart, Sunnyvale, CA (US)

(73) Assignee: ZOLL Circulation, Inc., Sunnyvale, CA (US)

( * ) Notice: Subject to any disclaimer, the term of this patent is extended or adjusted under 35 U.S.C. 154(b) by 277 days.

This patent is subject to a terminal disclaimer.

(21) Appl. No.: 12/099,661

(22) Filed: Apr. 8, 2008

(65) Prior Publication Data

US 2008/0255481 A1 Oct. 16, 2008

Related U.S. Application Data

(63) Continuation of application No. 10/686,186, filed on Oct. 14, 2003, now Pat. No. 7,354,407.

(51) Int. Cl.
*A61H 31/00* (2006.01)

(52) U.S. Cl. ..... 601/41; 601/DIG. 6

(58) Field of Classification Search ..... 601/41–44, 601/148–152, DIG. 6, 8, 9, 10, 11; 128/DIG. 20; 602/13; 242/586.2
See application file for complete search history.

(56) References Cited

U.S. PATENT DOCUMENTS

| | | | | |
|---|---|---|---|---|
| 3,802,638 | A * | 4/1974 | Dragan | 242/586.2 |
| 4,619,265 | A * | 10/1986 | Morgan et al. | 607/6 |
| 6,066,106 | A * | 5/2000 | Sherman et al. | 601/41 |
| 6,090,056 | A * | 7/2000 | Bystrom et al. | 601/41 |
| 2004/0116840 | A1 * | 6/2004 | Cantrell et al. | 601/44 |

FOREIGN PATENT DOCUMENTS

| | | | |
|---|---|---|---|
| JP | 6319791 | A | 11/1994 |
| JP | 2002238930 | A | 8/2002 |
| WO | 9909918 | A1 | 3/1999 |
| WO | 03024336 | A1 | 3/2003 |

* cited by examiner

*Primary Examiner* — Steven Douglas
(74) *Attorney, Agent, or Firm* — K. David Crockett, Esq.; Paul J. Backofen, Esq.; Crockett & Crockett, PC

(57) ABSTRACT

Devices and methods for attaching a belt cartridge to a belt drive platform. A clip attached to the belt is inserted into a slot in the drive spool of the belt drive platform. The cover plate of the belt cartridge fits into a channel beam in the housing of the belt drive platform, thereby securing the cartridge to the housing. Belt guards, for protecting the cartridge, belt drive platform, patient and rescuer, are rotatably attached to the cover plate and are secured around spindles disposed on the sides of the housing.

17 Claims, 5 Drawing Sheets

METHODS AND DEVICES FOR ATTACHING A BELT CARTRIDGE TO A CHEST COMPRESSION DEVICE

RELATED APPLICATIONS

This application is a continuation of U.S. application Ser. No. 10/686,186 filed Oct. 14, 2003 now U.S. Pat. No. 7,354, 407.

FIELD OF THE INVENTIONS

The inventions described below relate to emergency medical devices and methods and the resuscitation of cardiac arrest patients.

BACKGROUND OF THE INVENTIONS

Cardiopulmonary resuscitation (CPR) is a well-known and valuable method of first aid used to resuscitate people who have suffered from cardiac arrest. CPR requires repetitive chest compressions to squeeze the heart and the thoracic cavity to pump blood through the body. Artificial respiration, such as mouth-to-mouth breathing or a bag mask apparatus, is used to supply air to the lungs. When a first aid provider performs manual chest compression effectively, blood flow in the body is about 25% to 30% of normal blood flow. However, even experienced paramedics cannot maintain adequate chest compressions for more than a few minutes. Hightower, et al., *Decay In Quality Of Chest Compressions Over Time,* 26 Ann. Emerg. Med. 300 (September 1995). Thus, CPR is not often successful at sustaining or reviving the patient. Nevertheless, if chest compressions could be adequately maintained, then cardiac arrest victims could be sustained for extended periods of time. Occasional reports of extended CPR efforts (45 to 90 minutes) have been reported, with the victims eventually being saved by coronary bypass surgery. See Tovar, et al., *Successful Myocardial Revascularization and Neurologic Recovery,* 22 Texas Heart J. 271 (1995).

In efforts to provide better blood flow and increase the effectiveness of bystander resuscitation efforts, various mechanical devices have been proposed for performing CPR. In one variation of such devices, a belt is placed around the patient's chest and the belt is used to effect chest compressions. Our own patents, Mollenauer et al., Resuscitation device having a motor driven belt to constrict/compress the chest, U.S. Pat. No. 6,142,962 (Nov. 7, 2000); Sherman, et al., CPR Assist Device with Pressure Bladder Feedback, U.S. Pat. No. 6,616,620 (Sep. 9, 2003); Sherman et al., Modular CPR assist device, U.S. Pat. No. 6,066,106 (May 23, 2000); and Sherman et al., Modular CPR assist device, U.S. Pat. No. 6,398,745 (Jun. 4, 2002), and our application Ser. No. 09/866, 377 filed on May 25, 2001, show chest compression devices that compress a patient's chest with a belt. Each of these patents is hereby incorporated by reference in their entirety.

Since seconds count during an emergency, any CPR device should be easy to use and facilitate rapid deployment of the device on the patient. Our own devices are easy to deploy quickly and do increase the patient's chances of survival. Nevertheless, a novel compression belt cartridge has been designed to facilitate deployment, use and maintenance of chest compression devices.

SUMMARY

The devices and methods shown below provide for a belt cartridge for use in devices that perform chest compressions.

The cartridge has a belt, a compression pad attached to the belt, a cover plate through which the belt is threaded, a belt spline for attaching the belt to a drive spool of a belt drive platform, and belt guards rotatably attached to the cover plate. During use, the cover plate and belt guards are removably attached to the housing of the belt drive platform. In turn, the belt extends out of the housing and is secured around the patient.

The belt cartridge is attached to the belt drive platform via the cartridge cover plate. The belt itself is attached to a drive spool via a belt spline. The belt spline fits into a slot provided in the drive spool. The spline is provided with bosses or catches and the slot is provided with a corresponding shape so that the spline fits securely into the slot. A guide plate disposed around one end of the drive spool slot serves as a guide for inserting the spline. After the spline is inserted into the slot, the guide plate is adjusted to further secure the spline within the slot. Once the spline and belt are secured to the drive spool, the cover plate is attached to the housing of the belt drive platform.

Snap latches and hooks provided on the cover plate fit into corresponding detents and apertures in the housing of the belt drive platform so that the cover plate is secured to the housing. Belt guards disposed on the lateral ends of the cover plate are then closed around spindles disposed on the belt drive platform. The belt guards further secure the cover plate to the belt drive platform and protect the patient, rescuer and belt during use. In addition to the belt guards, labels are provided on the housing, cover plate and belt to indicate to the user the correct method of attaching the cartridge to the belt drive platform and on the correct method of wrapping the belt around the patient.

DETAILED DESCRIPTION OF THE INVENTIONS

Figure 1:
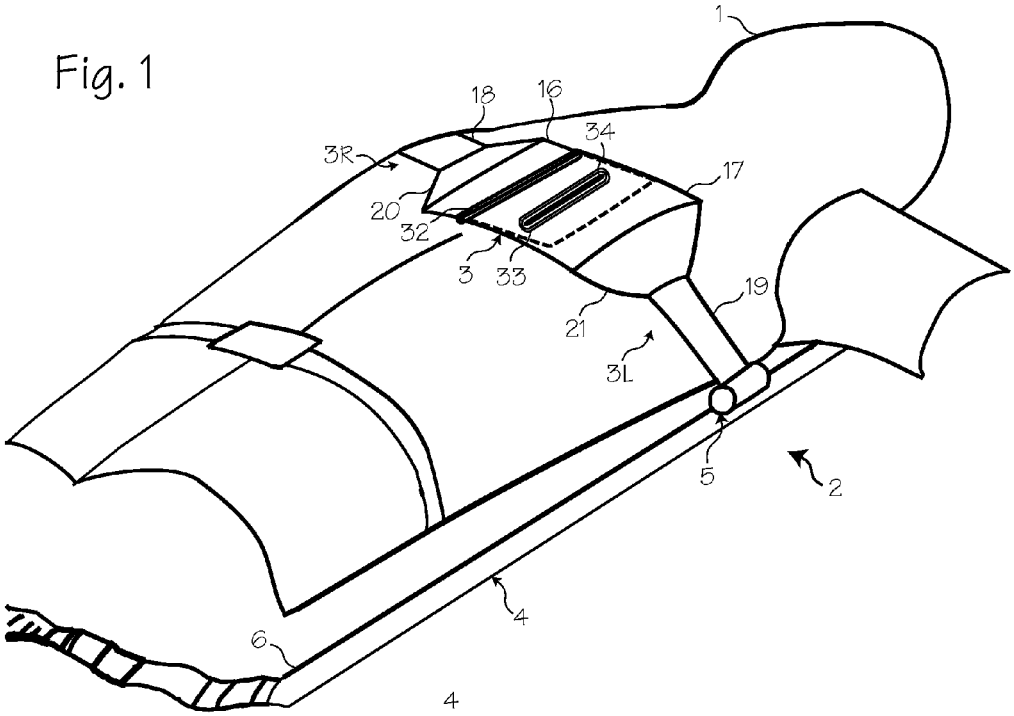
FIG. 1 shows the chest compression belt fitted on a patient.

FIG. 1 shows the chest compression belt fitted on a patient 1. A chest compression device 2 applies compressions with the belt 3, which has a right belt portion 3R and a left belt portion 3L. The chest compression device 2 includes a belt drive platform 4 and a compression belt cartridge 5 (which includes the belt). The belt drive platform includes a housing 6 upon which the patient rests, a means for tightening the belt, a processor and a user interface disposed on the housing. The means for tightening the belt includes a motor, a drive train (clutch, brake and/or gear box) and a drive spool upon which the belt spools during use. Various other mechanisms may be used to tighten the belt, including the mechanisms shown in Lach et al., Resuscitation Method and Apparatus, U.S. Pat. No. 4,774,160 (Sep. 13, 1988) and in Kelly et al., Chest Compression Apparatus for Cardiac Arrest, U.S. Pat. No. 5,738,637 (Apr. 14, 1998). The entirety of these patents is hereby incorporated by reference.

In use, the patient is placed on the housing and the belt is placed under the patient's axilla (armpits), wrapped around the patient's chest, and secured. The means for tightening the belt then tightens the belt repetitively to perform chest compressions.

The compression belt 3 shown in FIG. 1 is provided with a structure that aids in performing compressions effectively and efficiently. Specifically, the belt is shaped like a double-bladed oar. The wider load distribution sections 16 and 17 of the belt are secured to each other over the patient's chest and apply the bulk of the compressive load during use. The narrow pull straps 18 and 19 of the belt are spooled onto the drive spool of the belt drive platform to tighten the belt during use. The trapezoid-shaped transition sections 20 and 21 reinforce the belt and transfer force from the pull straps to the load distribution sections evenly across the width of the load distribution sections. The narrow end of a trapezoid faces the pull strap and the wide end of a trapezoid faces a corresponding load distribution section.

The pull straps 18 and 19 of the belt are narrow so that the chest compression device may perform compressions more efficiently, thus saving battery power and prolonging the ability of the device to perform compressions. The narrow pull straps of the belt reduce the mass of the belt and reduce the torque necessary to tighten the belt around the patient's chest, particularly when the means for tightening the belt tightens the belt by spooling it around a drive spool. In addition, by using narrow pull straps, the belt may fit within a narrow channel beam in the belt drive platform. This reduces the weight and size of the belt drive platform and increases the strength of the platform by allowing a narrower channel beam (see item 45 of FIG. 2) to be used with the platform.

The load distribution sections 16 and 17 of the belt are wider than the pull straps to allow the chest compression device to perform compressions more effectively and more safely. The wider portions of the belt compress more of the chest, increasing blood flow and thus performing compressions more effectively. In addition, the wider portions of the belt allow more force to be applied to the patient by evenly distributing pressure on the patient's chest, thus increasing blood flow while making chest compressions safer for the patient.

The transition sections 20 and 21 of the belt transfer the tension from the pull straps to the load distribution sections and reinforce the belt. Thus, the transition sections narrow along the lateral portion of the belt.

The right load distribution section 16 and left load distribution section 17 of the belt are provided with hook and loop fasteners so that the belt may be secured to the patient's chest. (Securing the right and left load distribution sections to each other secures the belt around the patient's chest.) Preferably, the hook side of the hook and loop fastener is located on the anterior load distribution section of the belt (in this illustration, the left side is anterior to and superficial to the right load distribution section) so that the hooks do not contact carpet or other materials when the belt is open and splayed on the ground, though the hook and loop fasteners may be located anywhere on the load distribution sections of the belt. A handle 32 (more clearly shown in FIG. 2) is provided on the left end of the belt to aid in placing and removing the belt. The handle and user interface are located on the same side of the belt drive platform to make applying and removing the belt an ergonomic motion.

An eyelet 33 is provided in the left load distribution section of the belt and a corresponding registration peg 34 is provided in the right load distribution section of the belt. (The peg, eyelet and hook and loop fasteners may be disposed on either load distribution section.) To secure the belt to the patient, the left load distribution section is laid over the right load distribution section and the eyelet is aligned with the peg. (The peg fits within the eyelet.) The eyelet and peg assist the rescuer to properly register the load distribution sections with respect to each other and the patient, and thereby properly position the belt on the patient. The eyelet and peg are also long relative to the superior/inferior direction of the patient and are located in the center of the assembled load distribution sections. Thus, the eyelet and peg help the rescuer place the center of the load distribution sections over the center of the patient's sternum. In addition, since the right and left load distribution sections tend to pull away from each other when the belt is tensioned, the peg and eyelet further secure the load distribution sections of the belt to each other by resisting shear forces that tend to pull the sections apart.

In addition, the peg and eyelet enable the rescuer to repeatably release the belt and then secure the belt around the patient such that the belt has the same length each time the belt is secured around the patient. (During use the rescuer may need to release the belt and re-secure the belt around the patient without replacing the cartridge.) Since the belt maintains the same length, the chest compression device is much more likely to achieve the same depth of chest compressions after the belt has been re-secured as compared to before the belt has been re-secured.

The combination of hook and loop fasteners and the eyelet/peg fastener provides for a means for securing the belt around the patient. The same combination allows a rescuer to rapidly and easily release the belt. The rescuer may release the belt, even during compressions, by grasping the left end of the belt and lifting the left load distribution section from the right load distribution section. Thus, the securing mechanism is also an emergency release mechanism. To further enhance safety, the eyelet may be provided with an electrical contact switch, optical sensor or other electrical or mechanical means for determining whether the peg is inserted into the eyelet. Thus, a chest compression device with the appropriate software or hardware can sense whether the peg is fully inserted into the eyelet. If the peg is not in the eyelet, then the chest compression device will not perform compressions. The system will alert the operator if proper registration is not detected so that the operator may re-fit the belt.

Figure 2:
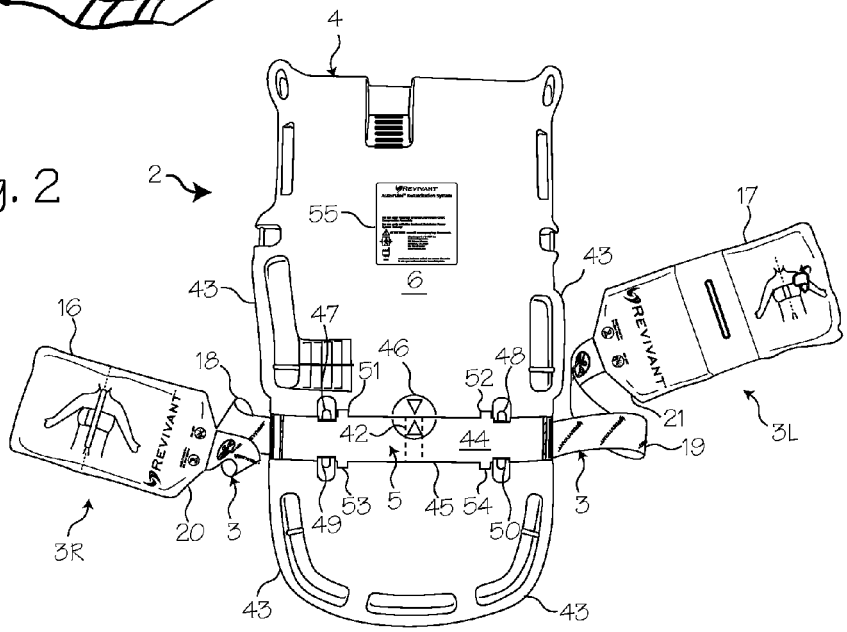
FIG. 2 shows a bottom view of a chest compression device that uses a belt to perform compressions.

FIG. 2 shows a bottom view of the belt drive platform 4 and shows the housing 6, a belt cartridge 5 attached to the housing and a means for tightening the belt disposed within the belt drive platform. The means for tightening the belt may comprise a drive spool 42 attached to the belt and to a motor. The drive spool is shown in phantom to indicate its position beneath the cover plate. The motor and associated components are located within the belt drive platform.

The belt drive platform is provided with a control system that controls how the belt is wrapped around the drive spool. For example, the drive spool is controlled so that some of the belt is left wrapped around the drive spool between compressions. When the means for tightening has loosened the belt around the patient, just before beginning the next compression, a length of the belt corresponding to one revolution of the drive spool is left wrapped around the drive spool. Thus, the belt will maintain its curled shape, reducing the chance of causing folds in the belt during compressions and increasing the efficiency of spooling the belt around the drive spool.

The housing serves as a support for the patient. Handles 43 provide for easy transport of the housing and of the patient while on the housing. The belt cartridge has a cover plate 44 that fits within a channel beam 45 in the belt drive platform, thus securing the belt cartridge 41 to the belt drive platform 4. Labels 46 are placed on the housing and cover plate to indicate the proper alignment of the cover plate. The cover plate is secured to and aligned within the channel beam by the use of retainer clips or snap latches 47, 48, 49 and 50 which fit between corresponding paired bosses or detents in the housing. Tabs integrally formed with the snap latches extend into slots disposed in the housing of the belt drive platform. The cover plate is also aligned and secured within the channel beam by the use of hooks 51, 52, 53 and 54 which fit into corresponding apertures in the housing. In addition, the cover plate is also provided with additional labeling 55 to provide warnings, manufacturer information, trademarks or advertising.

Figure 3:
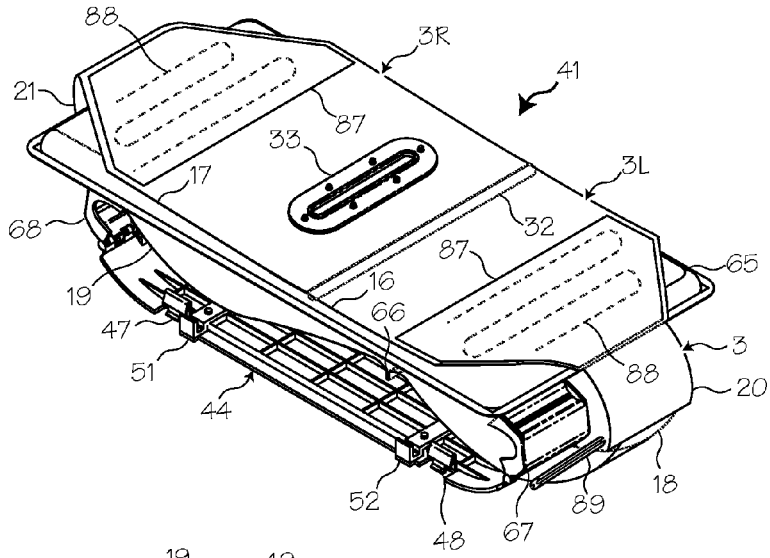
FIG. 3 shows a top (anterior) view of a belt cartridge used with a belt drive platform.
Figure 4:
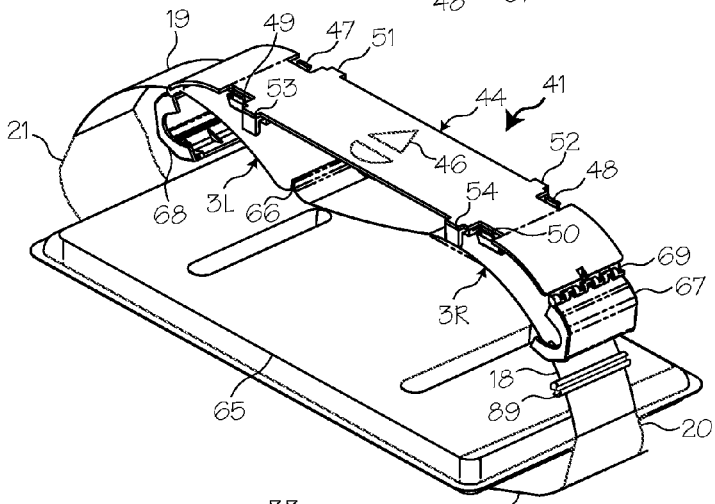
FIG. 4 shows a bottom (posterior) view of a belt cartridge used with the belt drive platform.
Figure 5:
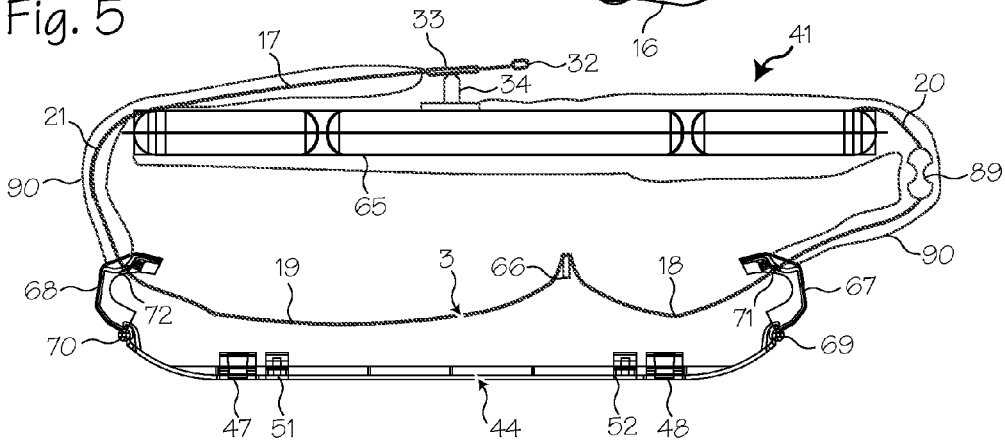
FIG. 5 shows a superior view of a belt cartridge used with the belt drive platform.

FIGS. 3, 4 and 5 show the belt cartridge 41. The belt cartridge is disposable so that there is no need to clean the belt, or other elements of the cartridge, after use. Thus, the belt cartridge reduces the exposure of subsequent patients and users to bodily fluids or other contaminants. If necessary, the cartridge may be replaced while the patient is still on the belt drive platform. In addition, since the belt cartridge is disposable the belt may be made of materials that readily conform to the shape of an individual patient, but have a shorter service life.

The cartridge includes a belt 3, a compression pad 65 attached to the belt, a belt clip, key or spline 66 for attaching the belt to a drive spool, a cover plate 44 and belt guards 67 and 68 rotatably attached to the cover plate via hinges 69 and 70. The belt guards are removably secured over spindles that are attached to the belt drive platform. A liner, sleeve or sock is disposed over the belt, as shown in FIG. 5. The belt is threaded through slots 71 and 72 disposed in the belt guards 67 and 68. With regard to the belt 3, the right portion 3R and the left portion 3L of the belt share pull straps 18 and 19 and each have a load distribution section 16 and 17 and a transition section 20 and 21. Each load distribution section of the belt is provided with hook and loop fasteners so that the belt may be secured around the patient's chest. Additionally, as described above, an eyelet 33 is provided in the left load distribution section and a corresponding peg 34 is provided in the right load distribution section (see FIG. 5). Preferably, the pull strap sections comprise a single strap.

The pull straps of the belt are secured to the drive spool of the belt drive platform with the spline 66, which is attached to the pull straps of the belt. The spline fits within a slot provided in the drive spool. When the drive spool rotates, the pull straps spool around the drive spool. The compression belt then tightens and is pulled onto the patient's chest, thereby accomplishing compressions.

The pull straps 18 and 19 of the belt are threaded through the belt guards 67 and 68 which are rotatably attached to the cover plate 44. The belt guards and cover plate are fashioned from a lightweight but strong plastic. The cover plate and belt guards are designed to allow the belt cartridge to be removably attached to the belt drive platform and to protect the belt during use. Specifically, the cover plate is provided with snap latches 47, 48, 49 and 50 that fit between corresponding paired bosses or detents on the housing. Integral tabs extend from the snap latches and fit into corresponding slots in the housing. The cover plate is also provided with hooks 51, 52, 53 and 54 that fit into corresponding apertures in the housing of the belt drive platform. The snap latches and hooks are designed so that the cover plate is removably attached to the belt drive platform without the use of tools. The snap latches and hooks may have a variety of shapes and forms. The snap latches and hooks may also be asymmetrical with respect to the cover plate, thus making it possible to fit the cover plate on the belt drive platform in only one orientation. To increase the ease of use of the cartridge, the cover plate is provided with labels 46 to indicate the desired orientation of the cover plate with respect to the belt drive platform.

Below the load distribution sections of the belt is a compression pad 65 that affects the distribution of compression force and assists in performing chest compressions. An example of a chest compression pad may be found in our application Ser. No. 10/192,771, filed Jul. 10, 2002. In one embodiment the compression pad is a three-sectioned bladder filled with foam. The compression pad is located on the belt so that it is centered over the patient's chest when the belt is in use. The compression pad is disposed below the load distribution sections of the belt and is removably attached to the belt with double-stick tape, hook and loop fasteners or comparable fastening means. The compression pad is also disposed inside the liner sock.

Additional safety features may be provided with the compression belt cartridge 41. For example, spreader bars or reinforcing plates 87 may be attached to the transition sections of the belt with stitches 88. (The reinforcing plates may be attached to the transition sections of the belt by any suitable method.) The reinforcing plates reinforce the transition sections of the belt and help prevent the transition and load distribution sections from twisting, bending, folding or otherwise deforming with respect to the pull straps, except in regard to the ability of the belt to wrap around the patient's chest. The reinforcing plates are made of a hard plastic or other non-resilient, though flexible material.

The belt also may be provided with one or more breakable couplings or breakable links 89 on one or both sides of the load distribution or belt transition sections. The breakable link 89 or links are interposed between sequential portions of the belt such that the belt separates if a link breaks. The link is designed to break at a predetermined tension. If the belt experiences an unsafe amount of tension, then a link breaks, the belt separates and the patient is thereby protected from excessive forces. What constitutes an unsafe amount of tension or excessive force varies, depending on the patient and the device and belt used, but is in the range of about 200 pounds to about 500 pounds as measured in the area of the belt to the side of the patient. Preferably, the link is designed to break under about 300 pounds of tension as measured in the area of the belt to the side of the patient. In addition, the link may be designed to reattach to itself or to a clip or other mating fastener after failure. Thus, in the event of link failure, the belt may be re-attached quickly and compressions may be restarted with minimal delay.

To prevent the load distribution sections from twisting relative to the other sections of the belt, the links may be designed to also serve as swivel joints, or the belt may be provided with additional swivel joints along the belt. The swivel joints connect the pull straps to the belt transition sections. The swivel joints allow the load distribution sections to twist relative to the pull straps, about the longitudinal axis of the belt, without twisting the pull straps themselves.

Another safety feature is a liner sock 90 for the belt (see FIG. 5). The liner sock surrounds the portions of the pull straps, as well as the compression pad, that contact the patient thereby protecting the patient from friction as the belt moves during compressions. The liner socks are attached to the belt guards around the belt guard slots so that hair, other body parts or other foreign objects cannot become caught in the belt guard slots. On the other end, the socks are disposed around and are attached to the load distribution sections of the belt.

In use, the belt spline is inserted into the drive spool of the belt drive platform. The cover plate of the cartridge is then inserted into the channel beam of the belt drive platform and fixed into place via the hooks and snap latches. The belt is wrapped around the patient, with the load distribution sections secured over the patient's chest. Thus, the chest compression device performs compressions by repetitively tightening the belt.

Figure 6:
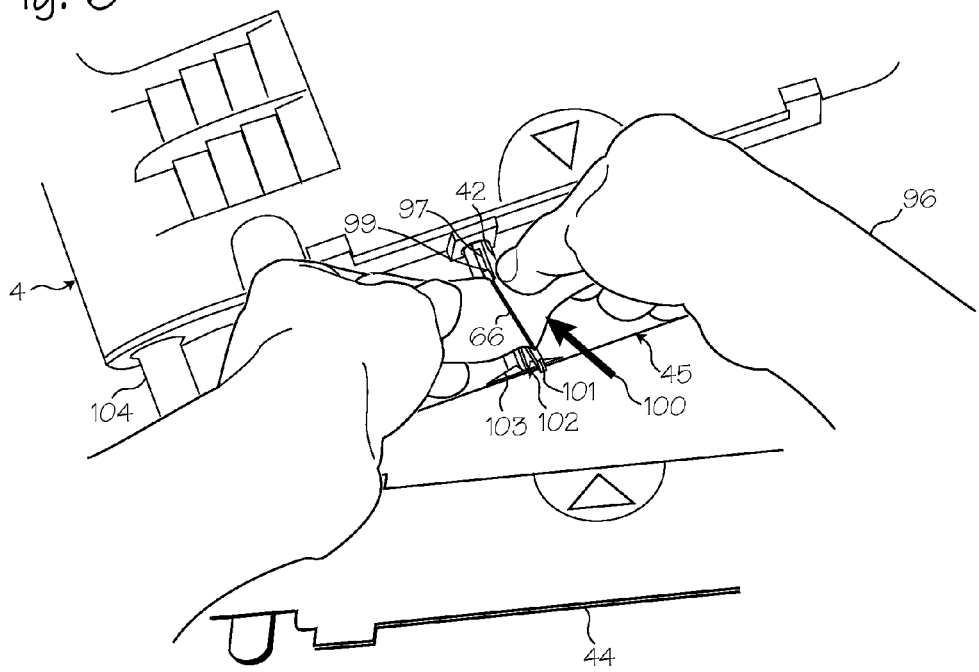
FIG. 6 illustrates a method of attaching the compression belt to the drive spool.

FIGS. 6 through 9 illustrate devices and methods for operably inserting the belt cartridge into the housing of the belt drive platform. FIG. 6 illustrates a user 96 inserting the belt spline 66 into the slot 97 in the drive spool 42. The user sets aside the cover plate 44 and inserts the front end 99 of the spline into the drive spool slot 97 in the direction indicated by arrow 100. The user then fits the back end 101 of the spline into a guide slot 102 disposed in a guide plate 103, which serves to further secure the spline in place, and secures the back end of the spline into the drive spool slot. The user then secures the cover plate over the channel beam 45. After securing the cover plate in the channel beam, the belt guards 67 and 68 attach to opposing rods, rollers or spindles 104 fixed to the sides of the belt drive platform. The spindles decrease friction as the belt travels along the spindles.

Figure 7:
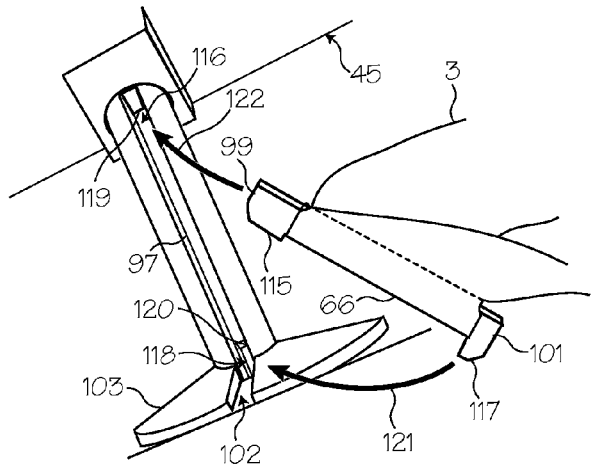
FIG. 7 shows a close-up view of the spline, the belt and the drive spool.

FIG. 7 shows a close-up view of the spline 66, the guide plate 103 and the drive spool slot 97. The spline is provided with a particular shape so that the spline will fit more securely within the drive spool slot. The shape of the spline also discourages the use of splines not designed by the manufacturer and discourages placement of the spline in an incorrect orientation. Thus, the spline is keyed to the drive spool slot.

Specifically, the spline 66 is provided in the form of a rectangular rod or bar made of a hard plastic or a metal. The front end 99 of the spline is provided with a protruding foot, boss or catch 115 shaped to fit into the front end 116 of the drive spool slot. Likewise, the back end 101 of the spline is provided with a second protruding foot, boss or catch 117 shaped to fit into the back end 118 of the drive spool slot. (The spline may have other shapes to accommodate differently shaped slots in the drive spool.)

The drive spool slot is provided with corresponding recesses 119 and 120 to accommodate the front and back catches on the spline respectively. Thus, the spline resembles a key and can function in a similar manner with respect to the use of the chest compression device. In addition to the catches, slots and recesses shown, the spline is further held in place with one or more detents in the belt drive platform that engage the front or back catches on the spline. The detents also serve as catches inside the belt drive platform that prevent the drive spool from rotating when the spline is not inserted in the drive spool slot. Thus, the device will not operate unless the spline is correctly inserted into the drive spool slot. In addition, the front end of the spline engages an electromechanical switch when inserted into the slot. When the spline engages the switch, a signal is generated (or interrupted) that informs the control system that the clip is present and properly engaged. Additionally, the belt drive platform may be provided with hardware or software that detects whether the spline is correctly inserted and informs the user of incorrect insertion and prompts the user to re-insert the spline if the spline is not correctly inserted.

The spline, cover plate or belt drive platform may be provided with a means for ensuring that a particular compression belt cartridge will only be used once (that is, used on only one patient during one rescue attempt). For example, the spline may be provided with a breakaway or deformable tab that, on insertion into the drive spool slot, renders the spline unusable after the spline has been removed from the spool shaft slot. Additionally, the spline may have a means for identifying whether the spline was produced by an approved manufacturer or whether the spline previously had been attached to the drive spool slot of a belt drive platform. For example, an RF identification tag or other wireless communication mechanism could be attached to the spline, wherein the RF tag transmits data corresponding to a unique identifying number. A magnetic strip may also be attached to the spline that stores a unique identifying number. A given belt drive platform will operate only if the identifying number corresponds to a number provided to the platform by the manufacturer and only if that number has not been used with the belt drive platform in the past. If the belt drive platform is connected to a network, then any belt drive platform connected to the network may be programmed to recognize when a particular belt cartridge has been used with any other belt drive platform. Moreover, the belt drive platform may be programmed to alter the identifying number on the spline, thereby rendering the cartridge unusable with any other belt drive platform. If this feature is implemented, the belt drive platform may be accompanied by an over-ride feature that allows a used cartridge to be used again. Thus, in the unusual situation where multiple heart attack victims are encountered or where a used cartridge is the only available cartridge, the cartridge may be used again.

To further secure the spline within the drive spool slot, a collar or guide plate 103 is provided around one or both ends of the drive spool 42. The guide plate is provided with a guide plate slot 102 through which the back end of the spline is inserted. After the spline is inserted, the guide plate is adjustable to firmly secure the spline within the drive spool slot. A user may manually move the guide plate sufficiently to insert the spline into and remove the spline from the slot.

The guide plate may be spring loaded and pushed into the wall of the channel beam to make room for inserting the spline, or the guide plate may be rotated (or rotated and pushed) to secure the back end of the spline within the drive spool slot. If the guide plate is spring loaded, the spring comprises a means for providing a biasing force to the guide plate; however, other means for biasing the guide plate may be used, such as a flexible tab. In any case, the guide plate may be disposed in relation to the drive spool such that the spline may not be inserted into or removed from the drive spool slot unless the guide plate or the drive spool is moved. This ensures that the spline will remain secured to the drive spool during use and during storage (while the drive spool is rotating and while the drive spool is stationary).

In use, the spline is inserted into the drive spool slot as shown by arrows 121 and 122. When the drive spool rotates, the belt 3 wraps or spools around the drive spool, thereby tightening the belt. As the belt is tightened the patient's chest is compressed. The patient's chest is decompressed as the drive spool rotates in the opposite direction, thereby allowing the belt to unwind and relax. After use, the process of inserting the belt may be reversed to detach the belt cartridge from the belt drive platform. Thus, the belt cartridge may be replaced after each use of the belt drive platform. Preferably, all of the attachment mechanisms are releasable, as described above, so that the operator can replace the belt without the use of special tools.

Figure 8:
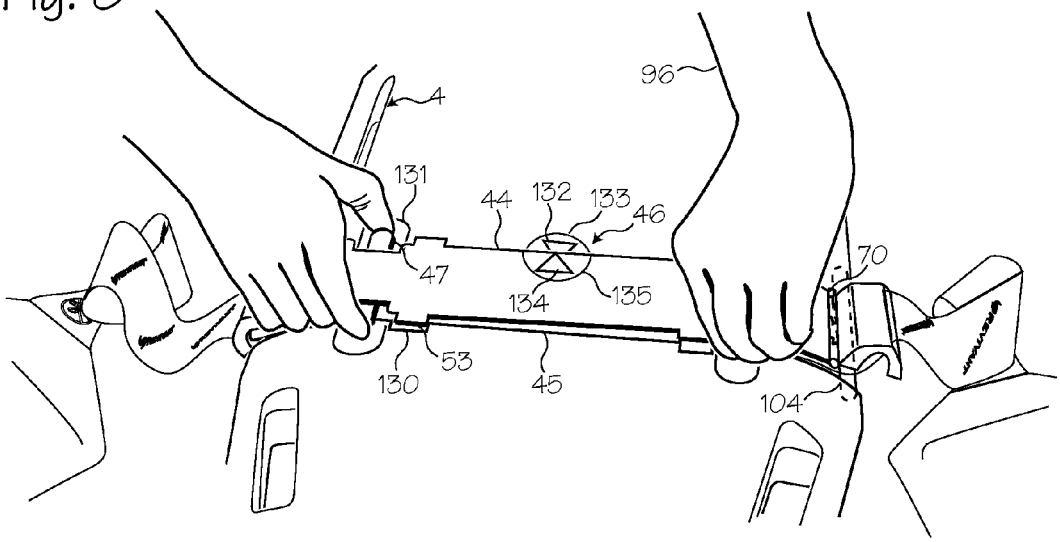
FIG. 8 illustrates a method of attaching the belt cartridge to the belt drive platform.

FIG. 8 illustrates a method of attaching the belt cartridge to the housing of the belt drive platform. The belt cartridge cover plate 44 is attached to the channel (established by beam 45) in the belt drive platform. Labels 46 allow the user to easily align the cover plate within the channel beam. Hooks 53 on the cover plate fit into corresponding apertures 130 in the belt drive platform. Belt guards 67 are removably disposed around spindles 104. (The spindle is shown in phantom to indicate its position underneath the belt guard and within the belt drive platform). In addition, snap latches 47 fit within paired detents that extend from the edges of slots 131 in the belt drive platform. Tabs extending from the snap latches fit within the slots themselves.

The labels include an arrow 132 disposed in a recess 133 in the belt drive platform and an arrow 134 disposed in a recess 135 on the cover plate 44. The cover plate is correctly aligned within the channel beam when the arrow on the belt drive platform is pointing at the arrow on the cover plate. The hooks and snap latches on the cover plate then fit within corresponding apertures and slots within the belt drive platform.

The snap latches are designed so that an audible click is heard when a snap latch is fully inserted into a corresponding slot. The snap latches may be designed so that they bend as they fit between the detents. When fully inserted, a flange on the end of the snap latch slips with respect to the detents, making an audible click when the flange strikes the edge of the slot. In addition, the hooks and snap latches may be aligned so that the belt cartridge only fits in one orientation with respect to the belt drive platform. For example, the snap latches or hooks may be spaced asymmetrically with respect to cover plate so that if the cover plate is incorrectly oriented the cover plate will not fit into the channel beam.

Figure 9:
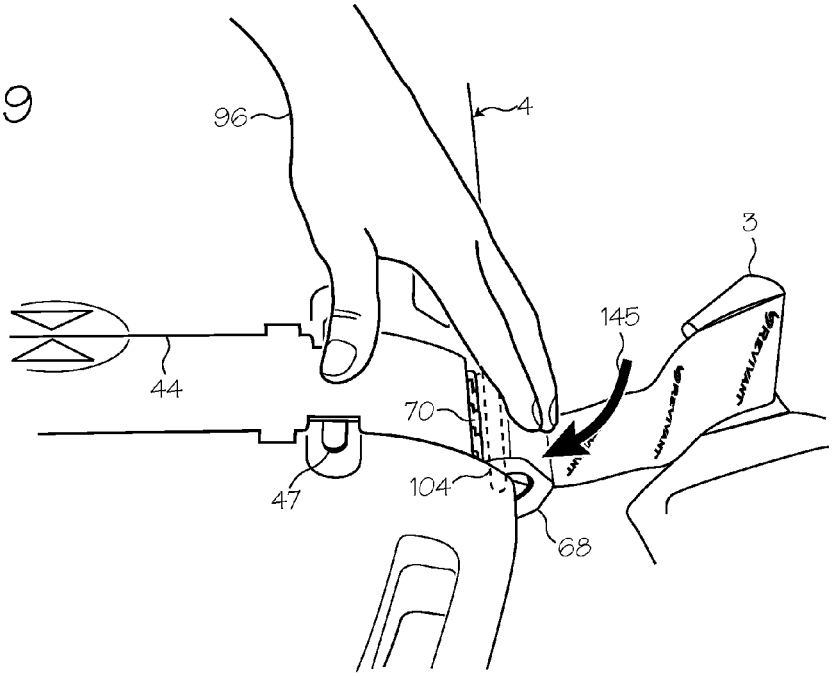
FIG. 9 illustrates a method of attaching a belt guard to a spindle of the belt drive platform.

FIG. 9 shows a method of attaching a belt guard 68 to a spindle 104 of the belt drive platform 4. The cover plate 44 has already been secured to the belt drive platform, though the hinges 70 allow the belt guard to rotate with respect to the belt drive platform and cover plate. The belt guards are provided with a hook-shape so that they securely attach around the spindles 104 fixed to the belt drive platform. The user may secure the belt guards around the spindles, as indicated by arrow 145.

In use, the belt guards protect the patient, rescuer, belt, belt cartridge and belt drive platform. The belt guards prevent foreign objects from entering the belt drive platform and becoming caught in the channel beam. Thus, a user's fingers or clothes, patient's clothes or body parts, or debris located near the site of emergency cannot enter the belt drive platform and damage the patient, the rescuer or the various parts of either the belt drive platform or the belt cartridge.

Figure 10:
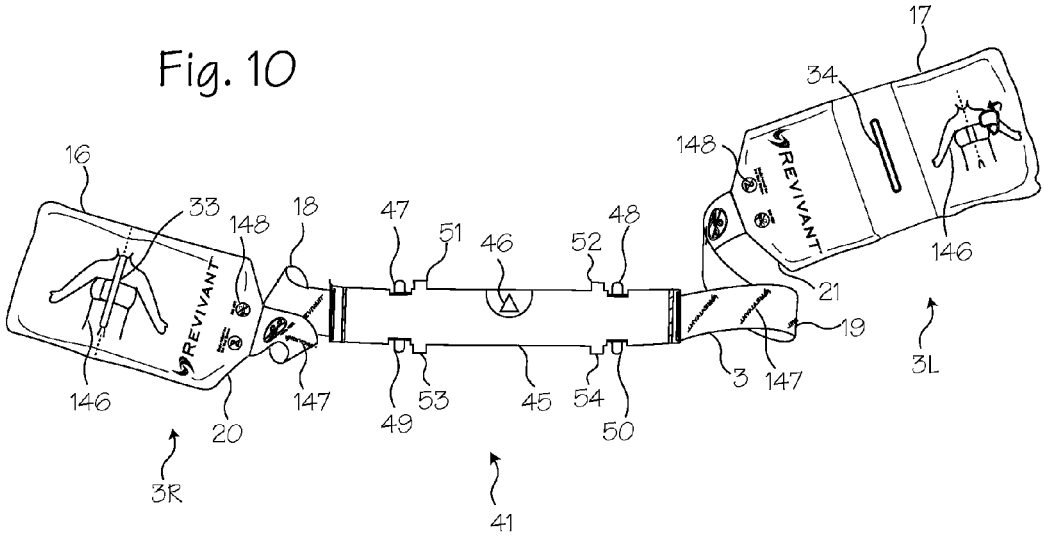
FIG. 10 shows a close-up view of the compression belt cartridge.

FIG. 10 shows a close-up view of the compression belt cartridge 41. Instructions 146 on how to deploy the compression belt cartridge or the belt drive platform are printed on the outer surface of the belt 3, belt liner, cover plate, compression pad or any other component of the compression belt cartridge. Specifically, indicia including pictorial instructions and written instructions (including Braille) show the rescuer how to correctly secure the compression belt around the patient.

Markings 147 on the outside of the belt liner indicate when the belt straps have been twisted. The markings may be lines that are oblique or skew to the longitudinal axis of the belt or belt liner, but may also be areas of solid colors on one side of the belt or belt liner. Preferably, less than the entire surface of one side of the belt liner is painted or marked. (Excessive ink, dye, transfer or adhesive elements, such as stickers, cause the liner to become too stiff, thereby significantly increasing the chances that the belt liner will wear prematurely.) The markings 147 may also serve as a means for identifying the manufacturer; for example, the markings may show the manufacturer name or other advertising information.

In addition, markings are provided to show a rescuer how to correctly align the compression belt and the belt drive platform with the patient. A yellow or other brightly colored orientation line is disposed along the superior edge of the load distribution sections of compression belt, parallel to the longitudinal axis of the compression belt. When the compression belt is correctly placed on the patient the yellow line will line up with the patient's axilla (armpits). Furthermore, the yellow line also lines up with a corresponding yellow strip disposed on the housing of the belt drive platform. Thus, a rescuer can easily visualize when the belt and belt drive platform are correctly oriented with respect to the patient and to each other. (Other marking schemes may also be used in relation to other anatomical landmarks such that the placement of the orientation lines may be varied.)

Similarly, the alignment peg on the load distribution section indicates that the patient should be aligned on the center of the belt drive platform and that the load distribution sections should be aligned on the center of the patient's chest. Thus, when the belt is placed correctly, the peg lies over the center of the patient's sternum. Preferably, the peg is long relative to the superior-inferior direction such that the longitudinal axis of the peg lies directly over and parallel to a superior-inferior line in the center of the patient's sternum.

The instructions, alignment arrows and cartridge components are color coded (or otherwise uniquely marked) to be easier to read and understand, or to indicate the purpose of the instructions. For example, the eyelet 33 and peg 34 are colored yellow (or otherwise uniquely colored or marked) to indicate that they mate. The belt cartridge also may be provided with colored warning or instruction labels 148 (multiple colors and color schemes may be used). Examples of warning or instruction labels include: "Align the armpits onto the yellow line," "LifeBand straps 90 degrees to platform," "Do not cut," "Do not twist" or "Single patient use do not reuse." Each warning may be assigned a different color, such as red, blue, black and gray.

The devices and methods shown above in reference to the figures may be modified. For example, the spline may be a hemisphere and attach to a corresponding hemisphere on the drive spool. The slot in the drive spool may extend through the drive spool and the belt threaded through the slot. The spline may also be provided with arms that clip around the drive spool and thereby secure the spline to the drive spool. The spline may be provided with magnets, a collar, detents or other latching features to ensure that the spline remains attached to the drive spool during use. In the case of a magnet, the wrapped portion of the belt around the drive spool holds the belt in place when the load becomes large.

The hook and loop fasteners may be replaced with buckles. The cartridge may be provided with a processor and a speaker, with the processor programmed to give audio instructions to the user. In addition, other means for tightening the belt may be used, such as multiple motors and drive spools, pistons, scissors mechanisms or other mechanical actuators.

Similarly, the drive spool or drive spools may have different shapes. If so, then the connection between the pull straps and the drive spool may have to be altered to accommodate the new drive spool shape. For example, a drive spool may have a conical shape and the pull straps replaced with pull cables or with pull straps made of a material without resin. In this case, the belt or cables may be fixedly attached to the drive spool.

Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

We claim:

1. An apparatus for performing chest compressions on a patient comprising:

a housing;

a drive spool operably attached to the housing; and an electric motor disposed within the housing and operably attached to the drive spool for rotating the drive spool;

a compression belt cartridge comprising:

a belt suitable for compressing the chest of the patient; and a clip attached to the belt for removably attaching the belt to the drive spool to enable rotation of the drive spool to tighten the belt and compress the chest.

2. The apparatus of claim 1 further comprising a slot disposed in the drive spool, said slot having a particular shape, wherein the clip has a particular shape conforming to the shape of the slot and wherein the clip fits into the slot.

3. The apparatus of claim 2 further comprising a means for identifying whether the clip is properly inserted into the slot, said means for identifying operably connected to the slot.

4. The apparatus of claim 1 further comprising a guide plate operably attached to the housing and to the drive spool, said guide plate having a slot disposed within the guide plate, said slot sized and dimensioned to permit passage of a portion of the clip into the drive spool slot.

5. The apparatus of claim 2 further comprising a guide plate operably attached to the housing and to the drive spool, said guide plate having a slot disposed within the guide plate, said slot sized and dimensioned to permit passage of a portion of the clip into the drive spool slot.

6. The apparatus of claim 5 wherein the drive spool is rotatable by the user and wherein clip may be inserted into the drive spool slot when the guide plate slot and the drive spool slot are aligned.

7. The apparatus of claim 5 wherein the guide plate is rotatable by the user and wherein the clip may be inserted into the drive spool slot when the guide plate slot and the drive spool slot are aligned.

8. The apparatus of claim 2 further comprising:

a guide plate operably attached to the housing, the guide plate being disposed in relation to the drive spool such that the clip may not be inserted into or removed from the drive spool slot unless the guide plate is moved relative to the drive spool; and a means for providing a biasing force to the guide plate such that the guide plate is biased to be disposed in relation to the drive spool to prevent the clip from being inserted into or removed from the drive spool slot, the biasing force selected to be overcome by a user to enable a user to manually move the guide plate sufficiently to insert the clip into or remove the clip from the slot.

9. The apparatus of claim 1 further comprising labels disposed on the housing indicating how to attach the clip to the drive spool.

10. The apparatus of claim 2 further comprising labels disposed on the housing indicating how to attach the clip to the drive spool.

11. The apparatus of claim 4 further comprising labels disposed on the housing indicating how to attach the clip to the drive spool.

12. The apparatus of claim 5 further comprising labels disposed on the housing indicating how to attach the clip to the drive spool.

13. The apparatus of claim 8 further comprising labels disposed on the housing indicating how to attach the clip to the drive spool.

14. The apparatus of claim 1 wherein the belt cartridge further comprises a cover plate operably attached to the belt, and wherein the cover plate is operably attached to the housing.

15. The apparatus of claim 14 further comprising a hook attached to the cover plate and a corresponding aperture disposed within the housing, wherein the hook fits within the aperture when the cover plate is attached to the housing.

16. The apparatus of claim 14 further comprising a snap latch attached to the cover plate and a corresponding pair of detents attached to the housing, wherein the snap latch fits between the corresponding pair of detents when the cover plate is attached to the housing.

17. The apparatus of claim 14 further comprising labels attached to the cover plate indicating how to attach the cover plate to the housing.

* * * * *